US009365918B2

(12) United States Patent
Binder et al.

(10) Patent No.: US 9,365,918 B2
(45) Date of Patent: Jun. 14, 2016

(54) METHOD AND APPARATUS FOR THERMAL SPRAYING

(71) Applicants: Kurt Binder, Cologne (DE); Norbert Németh, Hamburg (DE); Frank Gärtner, Hamburg (DE); Thomas Klassen, Wentorf (DE); Alexander List, Dresden (DE); Werner Krömmer, Landshut (DE); Peter Heinrich, Germering (DE); Heinrich Kreye, Hamburg (DE)

(72) Inventors: Kurt Binder, Cologne (DE); Norbert Németh, Hamburg (DE); Frank Gärtner, Hamburg (DE); Thomas Klassen, Wentorf (DE); Alexander List, Dresden (DE); Werner Krömmer, Landshut (DE); Peter Heinrich, Germering (DE); Heinrich Kreye, Hamburg (DE)

(73) Assignee: Linde Aktiengesellschaft, Munich (DE)

( * ) Notice: Subject to any disclaimer, the term of this patent is extended or adjusted under 35 U.S.C. 154(b) by 637 days.

(21) Appl. No.: 13/741,734

(22) Filed: Jan. 15, 2013

(65) Prior Publication Data

US 2013/0177712 A1 Jul. 11, 2013

(30) Foreign Application Priority Data

Jan. 17, 2012 (DE) ..... 10 2012 000 817

(51) Int. Cl.

| | |
|---|---|
| ***B05B 7/16*** | (2006.01) |
| ***B05B 5/03*** | (2006.01) |
| ***C23C 4/12*** | (2016.01) |
| ***F24H 3/04*** | (2006.01) |
| ***H05B 3/14*** | (2006.01) |
| ***H05B 3/44*** | (2006.01) |
| ***C23C 24/04*** | (2006.01) |
| *B05B 7/14* | (2006.01) |

(52) U.S. Cl.

CPC ..... *C23C 4/12* (2013.01); *B05B 7/1613* (2013.01); *C23C 24/04* (2013.01); *F24H 3/0405* (2013.01); *H05B 3/145* (2013.01); *H05B 3/44* (2013.01); *B05B 7/1486* (2013.01); *H05B 2203/022* (2013.01)

(58) Field of Classification Search

CPC ..... B05B 7/1613
USPC ..... 118/302, 620–640, 58, 59
See application file for complete search history.

(56) References Cited

U.S. PATENT DOCUMENTS

| | | | | |
|---|---|---|---|---|
| 3,828,161 | A | 8/1974 | Yamaguchi | |
| 4,271,207 | A * | 6/1981 | Loser | C23C 16/442 118/716 |
| 4,310,747 | A | 1/1982 | Rice et al. | |
| 5,459,811 | A * | 10/1995 | Glovan | B05B 7/164 118/302 |
| 5,764,850 | A | 6/1998 | Olstad et al. | |
| 2012/0272789 | A1* | 11/2012 | Auvinen | B01J 6/007 75/347 |
| 2013/0183453 | A1* | 7/2013 | Heinrich | B05B 7/162 427/456 |

FOREIGN PATENT DOCUMENTS

| | | | |
|---|---|---|---|
| DE | 20 38 917 | A1 | 2/1971 |
| DE | 23 05 105 | A1 | 8/1974 |
| DE | 10 2005 004117 | A1 | 4/2006 |
| DE | 10 2005 053731 | A1 | 5/2007 |

(Continued)

*Primary Examiner* — Yewebdar Tadesse
(74) *Attorney, Agent, or Firm* — Philip H. Von Neida

(57) ABSTRACT

An apparatus and methods for cold spraying with a spraying unit, a particle supply, a gas supply, and at least one heating unit. The heating unit contains a graphite felt that can be heated with an electric heater current, through which a gas stream can flow, wherein the at least one heating unit is arranged separately and/or in a pressure tank through which the gas stream can flow.

7 Claims, 4 Drawing Sheets

(56) References Cited

FOREIGN PATENT DOCUMENTS

| | | | |
|---|---|---|---|
| DE | 10 2006 014124 | A1 | 9/2007 |
| EP | 0924315 | A1 | 6/1999 |
| EP | 1 785 679 | A1 | 5/2007 |
| WO | WO 2009/096275 | A1 | 4/2006 |
| WO | WO 2007 110134 | A1 | 10/2007 |

* cited by examiner

METHOD AND APPARATUS FOR THERMAL SPRAYING

CROSS REFERENCE TO RELATED APPLICATIONS

This application claims priority from German Patent Application Serial No. 102012000817.1 filed Jan. 17, 2012

BACKGROUND OF THE INVENTION

The present invention relates to an apparatus for cold spraying and an accompanying method. The apparatus for cold spraying comprises a spraying unit, a particle supply, a gas supply and at least one heating unit characterized in that the heating unit exhibits a graphite felt that can be heated with an electric heater current through which a gas stream can flow, wherein the at least one heating unit is arrange separately and/or in a pressure tank through which the gas stream can flow. The method utilizes the apparatus in cold spraying operations.

Cold gas spraying is known. During cold gas spraying, metallic spray particles measuring 1 to 250 μm are accelerated in a gas stream to speeds of 200 to 1600 m/s, and sprayed onto a substrate. As a rule, a Laval nozzle is used for this purpose. The spray particles are not fused beforehand. Plastic deformation causes a coating to form during impact on the substrate. This requires exceeding the a minimum impact speed, the so-called critical speed, which depends among other things on the constitution and temperature of the spray particles.

Heating the gas stream also enables a warming of the spray particles. This leads to a thermal softening and ductilization, thereby reducing the critical speed. Heating further makes it possible to raise the sonic speed of the gas, and thus the flow rate in the nozzle, and hence also the speed of the spray particles upon impact. As a consequence, increasing the temperature of the gas stream increases both the temperature and speed of the spray particles upon impact. Both have a positive impact on the application efficiency and layer quality. Even if the temperature of the gas stream remains under the melting point of the spray particles during cold gas spraying, i.e., a "cold" gas stream is used by comparison to other spray methods, the gas stream is thus also heated up during cold gas spraying.

The gas pressure can also be raised to increase the speed of the spray particles, and is usually limited by installation engineering to 30 to 50 bar. Gases, such as the nitrogen often used in cold gas spraying, are often introduced into the nozzle with a temperature of several hundred degrees Celsius. It may here become necessary to cool the nozzles consisting of steel or carbide.

For example, a gas is heated in known gas heating units by guiding it through an oblong, resistively heated tube that consists of heat-resistant material, e.g., a nickel alloy such as Inconel, and is shaped like a coil or spiral.

Alternatively, use can also be made of so-called filament heaters. In the latter, thin wires comprised of a heat-resistant metal alloy, e.g., Kanthai (an Fe—Cr—Al alloy) and shaped into heating coils or spirals are arranged in a larger number of parallel aligned ceramic tubes. The wires are usually heated resistively. The gas to be heated is guided through the ceramic tubes, and flows outside along the heated wires. DE 10 2005 053 731 A1 discloses a corresponding filament heater with heat insulation.

Laid-Open Patent Specification DE 2 305 105 discloses a porous heating element made out of felted carbon of graphite fibers.

BRIEF SUMMARY OF THE INVENTION

The present invention proposes an apparatus for cold gas spraying and a corresponding method. The apparatus for cold spraying comprises a spraying unit, a particle supply, a gas supply and at least one heating unit characterized in that the heating unit exhibits a graphite felt that can be heated with an electric heater current through which a gas stream can flow, wherein the at least one heating unit is arrange separately and/or in a pressure tank through which the gas stream can flow. The method utilizes the apparatus in cold spraying operations.

Proposed according to the invention is a heating unit for heating a gas stream, in particular a unit or device for thermal spraying, and especially a cold gas spraying device, which exhibits a graphite felt that can be heated with an electric heater current, through which the gas stream can flow. According to the invention, this creates a new type of gas heater, whose heating element consists of graphite. Under oxygen-free conditions of the kind present in corresponding spraying processes, graphite is heat-resistant at temperatures up to 2200° C.

The use of graphite as a heating element in varying geometric shapes is also known in the art. However, graphite is here always used as a solid material. This is why the contact area between the graphite and medium to be heated, for example a gas, melt or solid, is only relatively slight. Correspondingly, only contact surfaces of 0.1 to 0.5 $m^2$ are achieved according to prior art. A streaming gas that only comes into contact with the surface for a very short time would here only warm up slightly.

By contrast, since graphite is not deformable like the aforementioned materials for metallic heating conductors in filament heaters, it cannot be utilized to fabricate tubes or thin wire coils that could be used in the currently known high-pressure gas heaters instead of metal alloys.

According to the invention, this problem is resolved through the already mentioned use of graphite felt. This yields a device for heating a gas stream, in particular for high-pressure gas heating, which can operate at high pressures and high temperatures. As a result, the gas can be heated to temperatures exceeding 1000° C., or exceeding 1200° C., and even exceeding 1500° C. The device according to the invention is suitable for heating nitrogen to temperatures clearly exceeding 100° C., for example during cold gas spraying. The material restricts the upper heating limit to about 2000° C. Nitrogen and helium as well as mixtures thereof are used to special advantage as the gases. However, it is also possible to use other gases and gas mixtures, for example argon or even other gas mixtures containing no oxygen.

Graphite felts consist of thin graphite fibers that are balled up and contact each other. When an electric voltage is applied to a graphite felt given suitable contacting, a current flows despite the discontinuity of the fibers, since it can also spread over the contact points of the fibers. As a result, a graphite felt becomes heated in its entirety as the current passes through, allowing it to heat a gas streaming through the graphite felt. Because the graphite fibers in the graphite felt are very thin, the surface over which the heat is conveyed to the gas is very large overall.

In a heating element of the kind that can be used in a heating unit according to the invention, i.e., a graphite felt, the surface measures at least 10 to 100 times the heating surface of at present conventional heaters, e.g., on the interior surface of a resistance-heated tube or on the wire coils of a filament heater.

Special advantages can be achieved by having a heating unit exhibit at least two channels that can carry a gas stream and are filled with the graphite felt heatable by a heater current. This makes it possible to specifically bring a corresponding gas stream into contact with the graphite felt, and allows the heater current to exert its maximum effect. As also explained below in greater detail, the targeted exposure of the channels able to carry a flow can be achieved by arranging gas distributors in an inflow region of a corresponding heating unit. For example, the latter can consist of double cones, punched disks, grids, guide plates or divergent inlet lengths. As also explained in greater detail below, a flow distribution element can simultaneously be designed as a contacting device and/or compressing structure. Providing several channels can optimize gas flow.

The mentioned channels can advantageously be at least in part coaxially arranged and/or designed as ceramic tubes. A corresponding configuration also enables the fabrication of exchangeable heating channels, which can be used in a pressure chamber of a heating device, for example in the form of a heating cartridge. Corresponding heating devices can be serviced especially well, wherein worn and/or contaminated graphite felt can be changed out.

A corresponding heating unit advantageously exhibits contacting devices for selectively contacting the channels with the heater current. For example, the contacting devices can be designed as massive graphite plates with corresponding channels or hole arrangements, which thus simultaneously represent flow distribution elements. At the same time, corresponding contacting devices can hold and/or compress a graphite felt in the channels that can carry a gas stream.

A corresponding heating unit further advantageously has means for providing a direct, 3-phase or alternating current as the heater current. The simplest case can here involve a suitable 3-phase or alternating current terminal. An alternating current or high-frequency heater can also be advantageous in certain applications.

In order to improve its efficiency, a corresponding heating unit exhibits at least a compressing structure, which when exposed to the gas stream can cause the graphite felt to compress. The simplest case can here involve a perforated plate, which is situated upstream from the graphite felt in a cylindrical heating device. The latter is provided with holes, which are dimensioned in such a way that the perforated plate offers a certain level of resistance to the gas stream. When a flow passes through such a perforated plate, it presses against the graphite felt, and compresses the latter. This enables a better electrical contact between the threads of the graphite felt, as well as between the graphite felt and contacting devices. On the other hand, this makes it possible to increase the flow resistance exerted by the graphite felt on the gas stream, resulting in a longer retention time of the gas stream in the graphite felt, and hence in a more effective transfer of heat.

Alternatively, the heating unit can also exhibit an essentially rigid framework, which incorporates the graphite felt. When exposed to the gas stream, this rigid framework then ensures that graphite felt compression is prevented or at least greatly impeded, since the rigid framework imparts support and structure to the graphite felt. A ceramic framework is particularly suited as the rigid framework.

The heating unit is advantageously designed as part of a heating device for heating a corresponding gas stream, which exhibits a pressure tank through which the gas stream can flow. The pressure tank incorporates the heating unit, and the gas stream flows through it. The heating unit can also be removed from the pressure tank and/or changed out accordingly. The interior of the pressure tank advantageously exhibits insulation. However, the insulation can also be secured to the heating unit. A corresponding gas distributor, in particular with the mentioned flow distribution elements, can be configured as part of the heating arrangement. As a result, the gas stream can be made to flow through a corresponding heating unit in an especially homogeneous manner. This ensures a particularly uniform and effective gas heating.

Therefore, a corresponding heating arrangement further advantageously exhibits at least one insulation, for example of the kind known from DE 10 2005 053 731 A1. This type of insulation makes it possible to reduce the temperature on the outside surface of the pressure tank relative to the hot gas to about 60% of the gas temperature, preferably to less than 40%, and given the appropriate configuration to less than 20% of the gas temperature, thereby improving the operability of the corresponding devices. Waste heat losses are also diminished.

An apparatus for thermal spraying, in particular for cold gas spraying, benefits in like manner from the advantages offered by the exemplified heating unit and/or heating arrangement. Such a thermal spraying arrangement encompasses a spraying unit, a particle supply and a gas supply, wherein the gas supply encompasses at least one heating unit and/or at least one heating arrangement of the kind exemplified above. For example, WO 2007/110134 contains a cold gas spraying unit, in which the heating unit and heating arrangement according to the invention can be used.

A corresponding thermal spraying method is distinguished by the use of a corresponding cold gas spraying device, at least one of the exemplified heating units and/or at least one of the exemplified arrangements.

In a corresponding procedure, a gas stream can be heated to a temperature of at least 700 to 2000° C., in particular of 800 to 1500° C. Heating can take place at a pressure of up to 100 bar, in particular at 30 to 60 bar. The gas stream can be provided at a volumetric flow rate of 50 to 400 $m^3$/h, in particular of 60 to 200 $m^3$/h. Gas speeds of up to 2500 m/s are reached in the procedure.

As already mentioned, we essentially know the influence which gas temperature and gas pressure have on the speed and temperature of particles during cold gas spraying, and also during other thermal spraying procedures. For example, if 25 micrometer copper particles are sprayed with nitrogen as the process gas using known nozzles (e.g., a type 24 de Laval nozzle), their impact speed at a pressure held constant at 50 bar can still be nearly linearly increased from approx. 400 m/s to over 700 m/s if the temperature of the used gas stream is raised from an ambient temperature to 1000° C. At a lower pressure of only 5 bar, the particle speed in the cited temperature range still increases from 350 to almost 550 m/s. The achievable impact temperatures for the particles here increase to as high as 400° C. Additional pertinent details may be gleaned from the publication by H. Assadi et al., "Particle acceleration, impact and coating formation in cold spraying", $8^{th}$ coll. on high-speed flame spraying, 2009, Erding, pp. 27 ff.

The higher the temperature during thermal spraying, in particular during cold gas spraying, the higher the speed and temperature of the particles upon impact. In particular using gas temperatures exceeding 1100° C. makes it possible to significantly expand the range of materials that can be processed into high-quality layers and structures via cold gas spraying.

To ensure that the particles adhere to the substrate, it is enough that the impact speed reaches the material-specific critical speed required for adhesion. High application efficiencies can be reached by exceeding this speed by 20 or 30% or more. If additional advantageous properties are desired, for example imperviousness to penetration by gases or liquids (a precondition for high corrosion resistance) or a high mechanical strength under a static and/or dynamic load, the impact speed should even exceed the critical speed by as much as 50% or more. As a result, higher gas temperatures make it possible not just to expand the range of materials that can be processed into layers and structures via cold gas spraying, but also to improve the quality of corresponding layers and structures. Another advantage to higher temperatures is that even particles coarser than before can be used for spraying, which also has a favorable impact on the properties of the layers and leads to lower costs. Materials that benefit in particular from the measures put forth in the invention are metals such as titanium, nickel and iron, and alloys thereof, as well as composites consisting of hard materials and metal matrices with high percentages of hard materials measuring up to 60% v/v, in isolated cases even up to 80%.

Examples for spraying materials that theoretically exhibit a high potential for application, but whose critical speed is so high as to preclude the generation of high-quality layers with a high application efficiency, include nickel, nickel alloys, e.g., Inconel, high-alloyed steels or metals with a high melting point, and in particular molybdenum and molybdenum alloys. Such materials can now also be processed via cold gas spraying by using the gas heating unit according to the invention. As a consequence, the invention makes it possible to process temperature-resistant materials, which also include heat-resisting alloys. Let special mention here be made of molybdenum, niobium and nickel alloys. The invention can be used to fabricate high-quality layers, whose properties are comparable to solid material with the same composition manufactured via melting metallurgy or sintering.

An apparatus according to the invention that exhibits a corresponding graphite heater can advantageously also be equipped with a spray nozzle that exhibits a graphite material. The term "graphite material" here also encompasses all graphite modifications, in particular so-called glassy carbon.

In the mentioned area of application, a graphite material offers a number of advantages, which in particular when combined enable the exemplified clearly elevated temperatures. Another advantage to a graphite material is that it prevents correspondingly hot spray particles from adhering to the interior nozzle wall.

In the preferred case of graphite, the advantage to a solid material is that its thermal conduction properties can become active in a special way. As a result, a corresponding nozzle is particularly effective in dissipating heat.

In particular, a nozzle exhibiting glassy carbon as the graphite material can be used for a method according to the invention. Glassy carbon, also referred to as vitreous carbon, here combines vitreous ceramic properties with those of graphite, thereby offering special advantages. Metallic, partially or fully ceramic spray nozzles and/or spray nozzles with corresponding inserts, e.g., ceramic nozzles with graphite inserts or metal nozzles with ceramic inserts, can also be advantageous. The respective materials can also be applied in the form of coatings, which permits an especially cost-effective manufacture by comparison to solid materials.

For example, an insert or inlay made out of a corresponding material, e.g., ceramic, graphite or glassy carbon, can be replaced very easily if worn out. It is also especially advantageous to use graphite materials in the form of composites. These can be materials based on metals and/or plastics.

In addition to the elucidated graphite heater, such an arrangement can also have other heating devices, e.g., to preheat the gas stream. For example, EP 0 924 315 B1 discloses a usable gas heater. The used gas or gas mixture is kept available in a gas pressure tank, and temporarily stored in a gas buffer tank. After removed from the gas buffer tank, the gas or gas mixture is heated by means of an electric resistance heater, inductively and/or with a plasma torch. A sufficiently intensive heating can also be achieved through the use of several heaters, in particular pre- and post-heaters of the kind disclosed in DE 10 2005 004 117.

It goes without saying that the features mentioned above and yet to be illustrated below can be used not just in the specified combination, but also in other combinations or in isolation, without departing from the framework of the present invention. Of course, the heating unit according to the invention and the heating arrangement according to the invention can also be utilized for other applications involving the use of a hot gas jet, for example for pre-warming while welding and hard soldering (for example, via electric arc or flame), for pre-warming while straightening or during similar processes, for soldering itself (when using a solder that melts in the hot gas jet), or for drying hydrogen-sensitive materials.

BRIEF DESCRIPTION OF THE DRAWINGS

The invention has been schematically depicted in the drawing based on an exemplary embodiment, and will be described in detail below with reference to the drawing.

DETAILED DESCRIPTION OF THE INVENTION

Figure 1A:
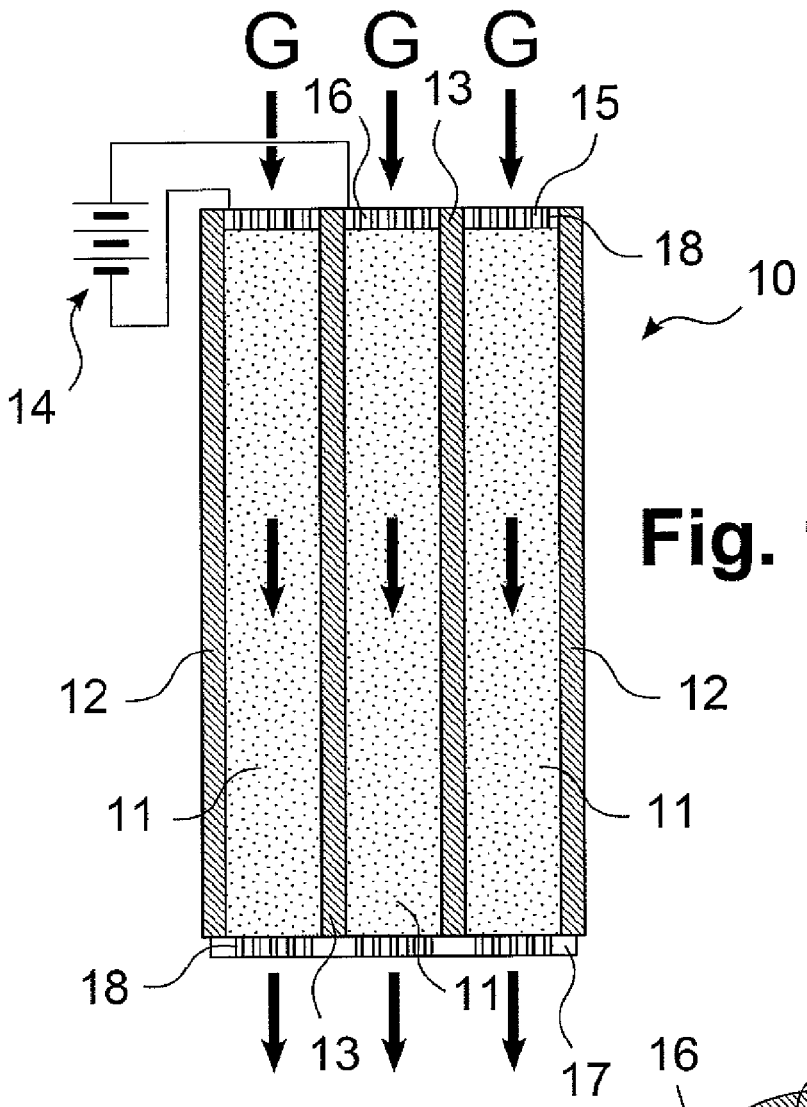
FIG. 1*a* is a longitudinal section of a heating unit according to an especially preferred embodiment of the invention.

FIG. 1 presents a longitudinal section of a unit for heating a gas stream according to an especially preferred embodiment of the invention, marked 10 overall. A gas stream is symbolized with solid arrows and marked G. The unit 10 exhibits a graphite felt 11, through which the gas stream G can flow. To this end, the graphite felt 11 is situated in corresponding channels 12 and 13, for example in ceramic tubes, in a coaxial configuration. Corresponding means 14 for providing a heater current are furnished, and displayed as a direct current source on FIG. 1. The means 14 for providing the heater current can expose the graphite felt 11 to a heater current via contacting devices 15 to 17.

The concept according to the invention was realized using a graphite felt with fibers having a diameter of approximately 15 μm. The thickness/length ratio of the fibers measured at least 100:1, preferably 1000:1. The graphite felt exhibited a density of only 0.09 g/cm$^3$. The density measured roughly 1/15 that of massive graphite due to the large cavities of the felt.

The respectively coaxially arranged channels 12, 13 are to this end covered by contacting devices 15, 16 in the form of perforated disks or plates on a first side of the heating unit 10, hereinafter referred to as "upper side". The configuration of perforated contacting devices 15, 16 is clearly evident from FIG. 1*b*. The contacting devices 15, 16 exhibit corresponding hole configurations with holes 18. The contacting devices 15, 16 are conductive in design, and provided, for example, in the form of graphite plates. The contacting devices 15 and 16 do not contact each other in the arrangement as depicted on FIG. 1*a*, and are electrically isolated from each other by the wall of the channel 13.

For example, the contacting device 15 can also be designed as a compressing structure. If a gas stream G flows through it, it can exert a pressure on the underlying graphite felt, thereby compressing the latter.

A second contacting device 17 also provided with holes 18 is located on a second side of the heating unit 10, hereinafter referred to as "lower side". The contacting device 17 can also be designed as a graphite plate. As opposed to the contacting devices 15, 16, the contacting device 17 does contact the graphite felt 11 in both channels 12, 13.

When a voltage is applied to the contacting devices 15, 16 via the poles of the means 14 for supplying the heater current, a current flows from the contacting device 15 through the graphite felt 11 located in channel 12, via the contacting device 17 and through the graphite felt 11 located in channel 13. Resistance effects cause the graphite felt 11 in channels 12 and 13 to heat up accordingly, thereby warming up the gas G streaming through the channels 12 and 13.

Figure 1B:
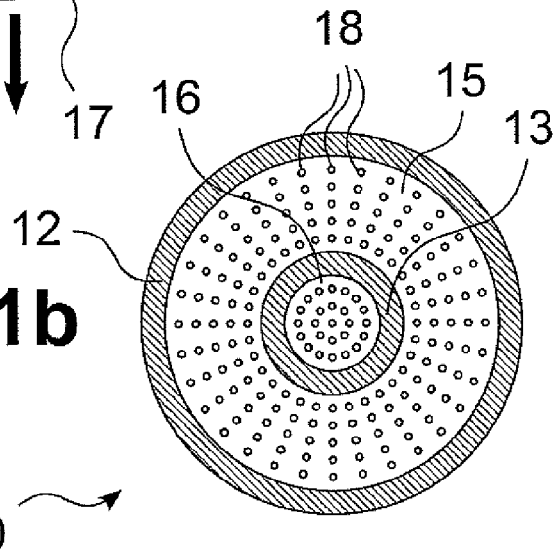
FIG. 1*b* is a top view of a heating unit according to an especially preferred embodiment of the invention.

FIG. 1*b* presents the arrangement 10 on FIG. 1*a* in a top view, i.e., from the upper side elucidated above. As clearly evident, the contacting devices 15, 16 do not contact each other in the arrangement depicted, but rather are separated from each other by the wall of the channel 13. To this end, for example, the channels 12, 13 are designed as non-conductive ceramic tubes. While the arrangement shown on FIG. 1*b* encompasses the essential components of the arrangement illustrated on FIG. 1*a*, FIG. 1*b* has been simplified in part.

Figure 1C:
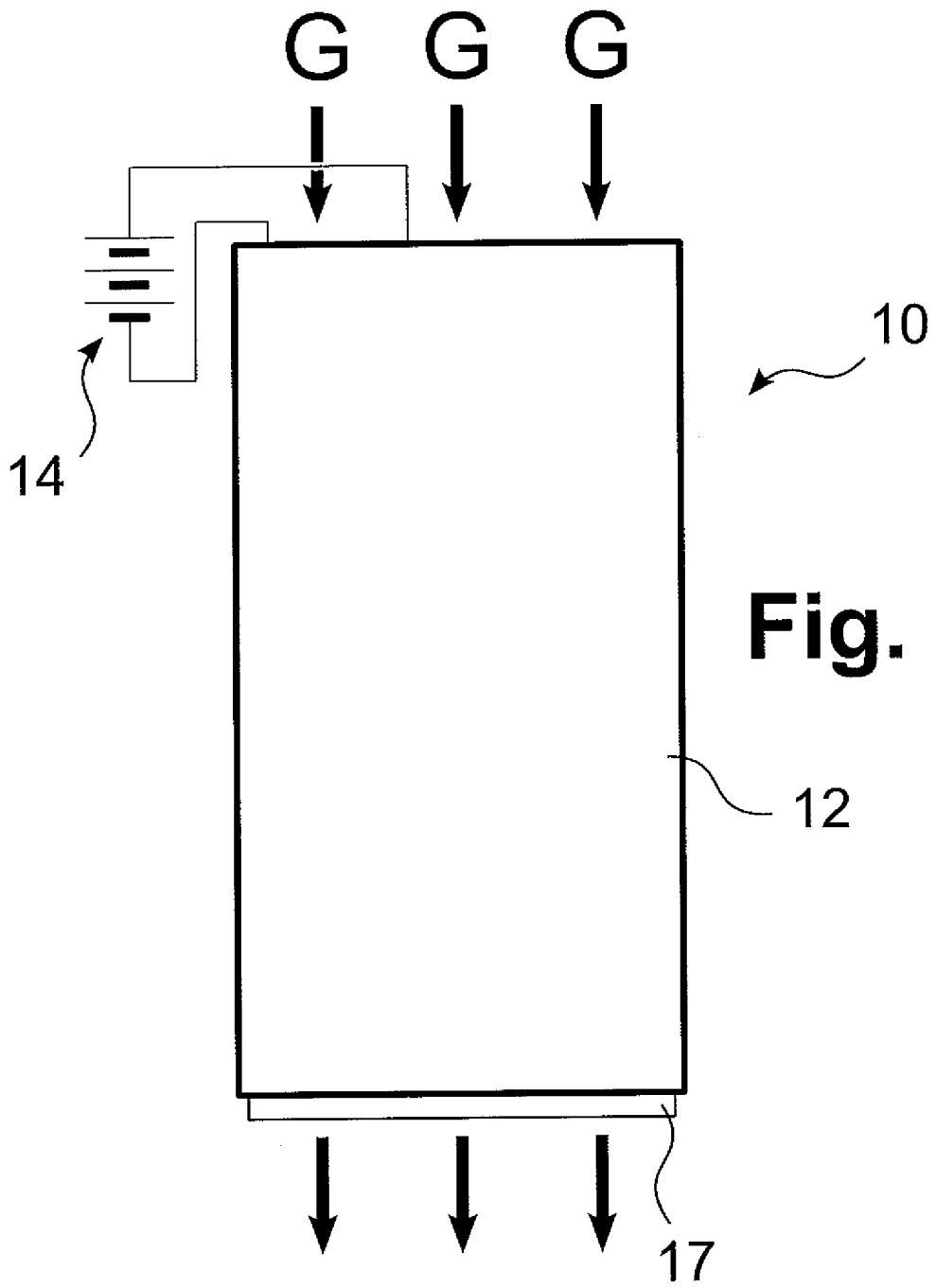
FIG. 1*c* is a side view of a heating unit according to an especially preferred embodiment of the invention.

FIG. 1*c* presents a side view of the arrangement 10. The viewing direction here corresponds to the one on FIG. 1*a*. In this case as well, elements corresponding to FIG. 1*a* are not labeled again. A wall of the channel 12 and the plate 17 are visible from the side view.

Figure 2:
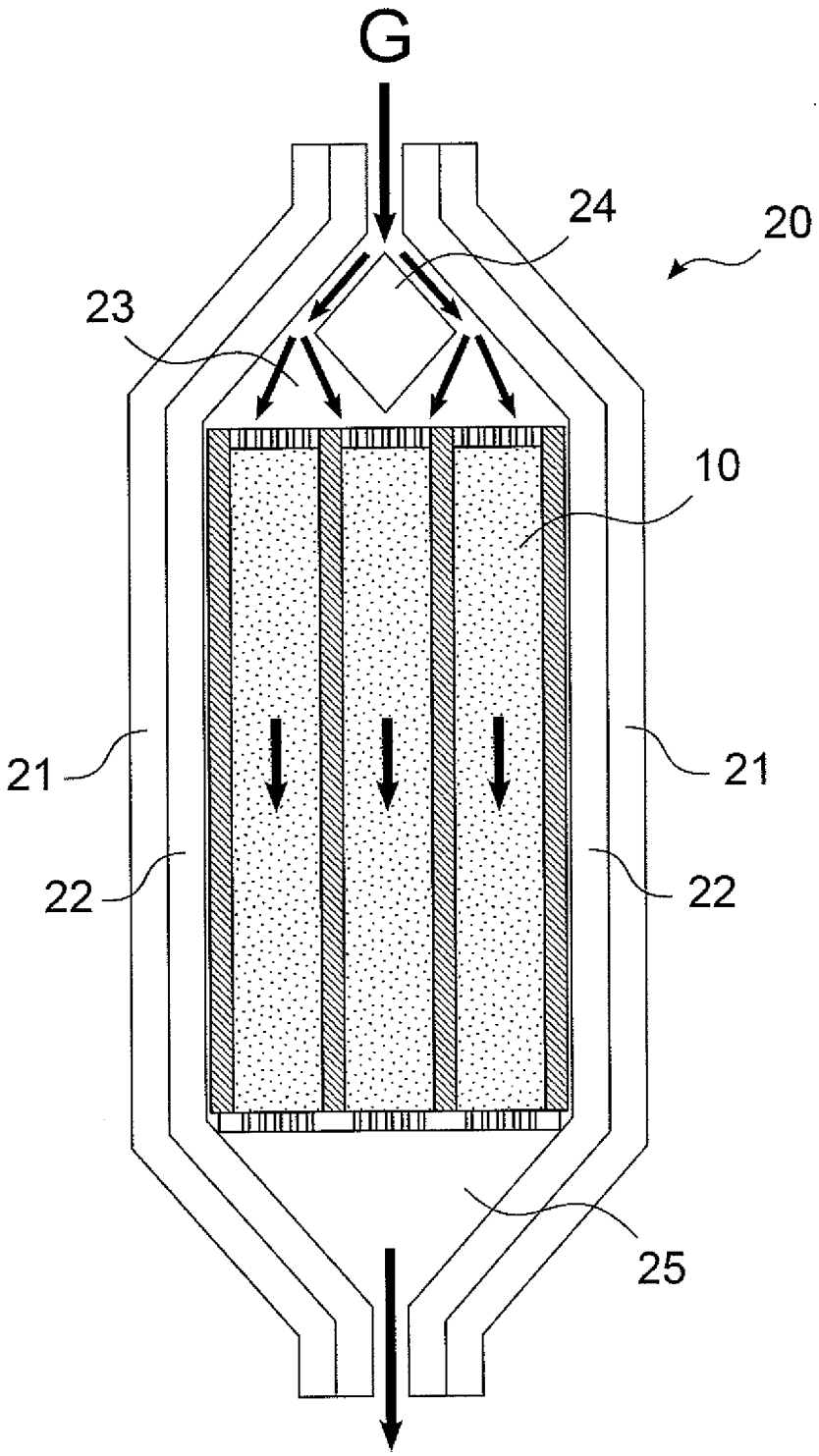
FIG. 2 is a longitudinal section of a heating device according to an especially preferred embodiment of the invention.

FIG. 2 presents a longitudinal sectional view of a heating arrangement according to an especially preferred embodiment of the invention. The overall heating arrangement is labeled 20, and exhibits a heating unit 10 exemplified above, whose individual elements will not be described again. The heating unit 10 is arranged in a pressure tank 21 of the heating unit 20. The gas stream G flows through the pressure tank as denoted by the solid arrows.

The gas stream G here first passes through an inflow region 23. The inflow region 23 exhibits a gas distributer 24, which ensures that the inflowing gas is distributed uniformly over the upper side of the heating unit 10 at a homogeneous speed. For example, the pressure chamber 21 is designed as a rotationally symmetrical body, and its inner side exhibits insulation 22. The device 20 according to the invention forms a standardized unit that is easy to change out, e.g., in the event of repairs, or several of the latter can be arranged one after the other. As explained above, the heating unit 10 can be designed as an easily replaceable heating cartridge. This makes it possible to also easily change out just the heating unit 10 during a repair job. As already mentioned, the gas stream G passes through the pressure tank 21, wherein the gas distributor 24, for example which can take the form of a double cone, distributes it uniformly over the cross section of the heating unit 10. As a result of the insulation 22 provided on the interior, only a little thermal energy is released to the outside through the wall of the pressure tank 21. For this reason, the pressure tank 21 can exhibit a relatively thin-walled and lightweight design. In a gas outlet region 25, the gas stream G exhibits the desired temperature, and exits the pressure tank 21.

Figure 3:
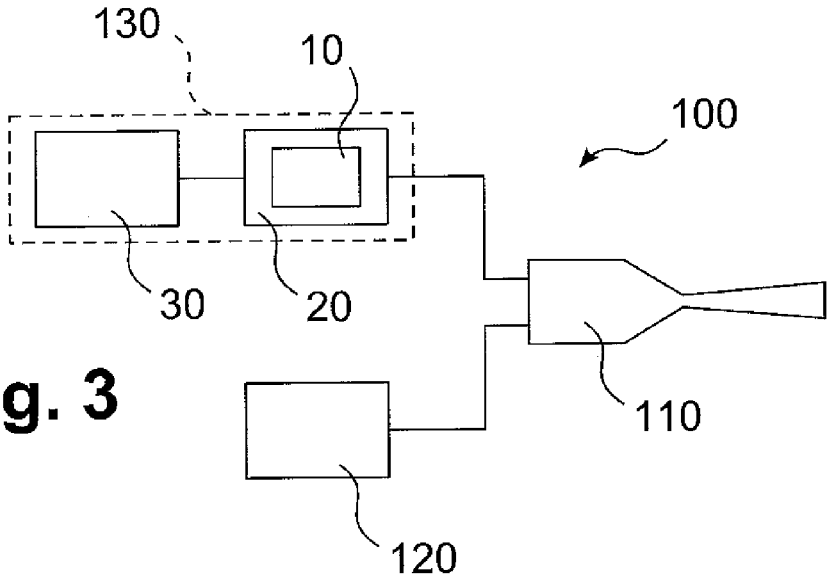
FIG. 3 is a schematic view of an arrangement for cold spraying according to an especially preferred embodiment of the invention.

FIG. 3 presents an arrangement for cold spraying according to a particularly preferred embodiment of the invention, which is marked 100 overall.

The arrangement 100 encompasses a spray gun 110, which can be designed in a known manner with a Laval nozzle. The nozzle can exhibit a graphite material. A particle supply device 120 can be provided, and used to supply corresponding spray particles to the spray gun 110. Further provided is a gas supply 130, which encompasses a gas storage unit 30. As explained above, a gas stream is guided from the gas storage unit 30 into a heating arrangement 20, which exhibits a heating unit 10. The expert will understand that several heating devices 20 and/or heating units 10 can also be provided so as to achieve the desired gas temperature. The correspondingly heated gas stream is also supplied to the spray gun 110.

REFERENCE LIST

G Gas stream
10 Heating unit
11 Graphite felt
12 Channel
13 Channel
14 Heater current preparing means
15 Contacting device
16 Contacting device
17 Contacting device
18 Hole
20 Heating arrangement
21 Pressure tank
22 Insulation
23 Inflow region
24 Gas distributor
25 Gas outlet region
30 Gas storage unit
100 Cold gas spraying arrangement
110 Spray gun
120 Particle supply device
130 Gas supply

What we claim is:

1. An apparatus for cold spraying, comprising a spraying unit, a particle supply, a gas supply, and at least one heating unit, characterized in that the at least one heating unit contains a graphite felt that can be heated with an electric heater current, through which a gas stream can flow, wherein the at least one heating unit is arranged separately and/or in a pressure tank through which the gas stream can flow, wherein the at least one heating unit comprises at least two channels that can carry the gas stream and are filled with the graphite felt heatable by electric heater current, contacting devices for selectively contacting the graphite felt in the at least two channels with the electric heater current, and wherein the contacting devices compress the graphite felt when exposed to the gas stream.

2. The apparatus according to claim 1, in which the channels are at least in part coaxially arranged and/or designed as ceramic tubes.

3. The apparatus according to claim 1, which comprises a rigid framework.

4. The apparatus according to claim 3, wherein said rigid framework is a rigid ceramic framework that incorporates the graphite felt.

5. The apparatus according to claim 1, wherein the at least one heating unit comprises at least one gas distributor and/or at least one heat insulation.

6. The apparatus according to claim 1, which further comprises a heating device for heating the gas stream that is operated inductively, resistively and/or by means of a plasma torch.

7. The apparatus according to claim 1, in which the spraying unit encompasses a nozzle that comprises a graphite-containing material or at least part of a graphite-containing material.

* * * * *